US009896313B2

(12) United States Patent
Roodenburg et al.

(10) Patent No.: US 9,896,313 B2
(45) Date of Patent: Feb. 20, 2018

(54) DOUBLE DRUM TRACTION WINCH

(75) Inventors: Joop Roodenburg, Delft (NL); Pieter Dirk Melis Van Duivendijk, Missouri City, TX (US)

(73) Assignee: ITREC B.V., Schiedam (NL)

( * ) Notice: Subject to any disclaimer, the term of this patent is extended or adjusted under 35 U.S.C. 154(b) by 454 days.

(21) Appl. No.: 14/113,190

(22) PCT Filed: Apr. 19, 2012

(86) PCT No.: PCT/NL2012/050264
§ 371 (c)(1),
(2), (4) Date: Dec. 6, 2013

(87) PCT Pub. No.: WO2012/144900
PCT Pub. Date: Oct. 26, 2012

(65) Prior Publication Data

US 2014/0199152 A1 Jul. 17, 2014

Related U.S. Application Data

(60) Provisional application No. 61/478,267, filed on Apr. 22, 2011.

(51) Int. Cl.
*B66D 1/26* (2006.01)
*B66D 1/74* (2006.01)
*B66D 1/30* (2006.01)

(52) U.S. Cl.
CPC ..... *B66D 1/26* (2013.01); *B66D 1/30* (2013.01); *B66D 1/7405* (2013.01)

(58) Field of Classification Search
CPC ..... B66D 1/28; B66D 1/30; B66D 1/7405; B66D 1/7415; B66D 1/7442;
(Continued)

(56) References Cited

U.S. PATENT DOCUMENTS 3,244,380 A * 4/1966 Hoyne ..... B21C 47/18 242/563.2
3,258,247 A * 6/1966 Jones, Jr. ..... B66D 1/76 242/366.2
(Continued)

FOREIGN PATENT DOCUMENTS

EP 0101134 A1 * 2/1984 ..... B65H 54/54
FR 1 394 141 A 4/1965
(Continued)

*Primary Examiner* — Sang K Kim
*Assistant Examiner* — Nathaniel L Adams
(74) *Attorney, Agent, or Firm* — Birch, Stewart, Kolasch & Birch, LLP

(57) ABSTRACT

A double drum traction winch of which the rotatable drums are both provided with adjustable grooves is provided. Each drum includes multiple, for example three or more, curved segments, each segment defining a section of a circumferential groove, such that multiple circumferential grooves on the outer surface of the drum are each composed of several curved segments. The curved segments are each movably supported by a core body for movement in a substantial radial direction relative to the rotational axis of the drum. An actuator mechanism for the curved segments is provided, that includes actuators that cause essentially radial displacement of the curved segments, such that the circumference of the grooves can be adjusted.

16 Claims, 6 Drawing Sheets

(58) Field of Classification Search
CPC .. B66D 1/7447; B66D 1/7452; B66D 1/7457; B66D 1/76; B66D 2700/183; B66D 1/36; B65H 75/247; B65H 75/242; B65H 75/246; B65H 75/248
USPC ..... 242/572, 573–573.2, 575.3–575.5; 254/278, 371–374, 383
See application file for complete search history.

(56) References Cited

U.S. PATENT DOCUMENTS

| | | | | | |
|---|---|---|---|---|---|
| 3,585,097 | A * | 6/1971 | Beason | ..... | B29C 65/18<br>156/582 |
| 4,160,530 | A * | 7/1979 | Plach | ..... | B65H 75/242<br>242/575.3 |
| 2010/0224844 | A1* | 9/2010 | Boussaton | ..... | B66D 1/7405<br>254/290 |

FOREIGN PATENT DOCUMENTS

| | | | | | |
|---|---|---|---|---|---|
| FR | 2919280 | A1 * | 1/2009 | | |
| GB | 868 969 | A | 5/1961 | | |
| GB | 2197840 | A * | 6/1988 | ..... | B66D 1/7405 |
| WO | WO 00/10903 | A1 | 3/2000 | | |

* cited by examiner

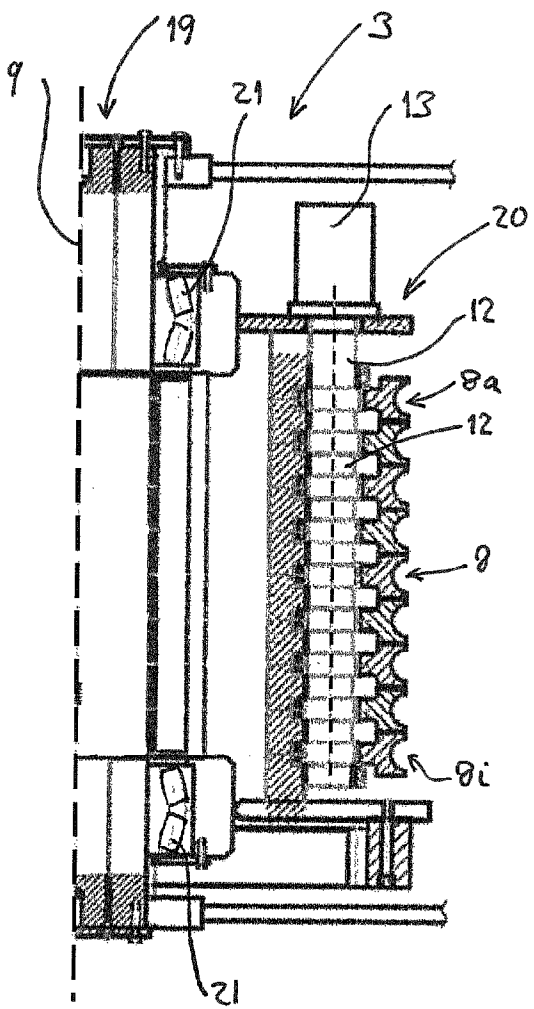
fig. 5
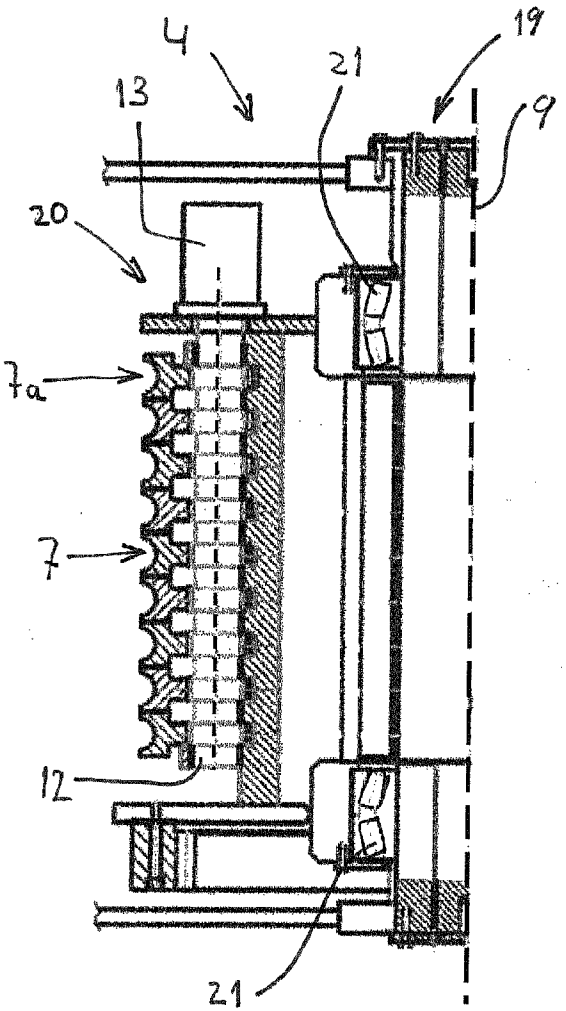

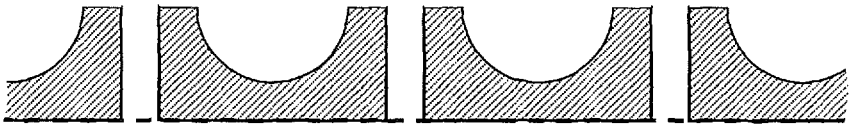
fig. 6a
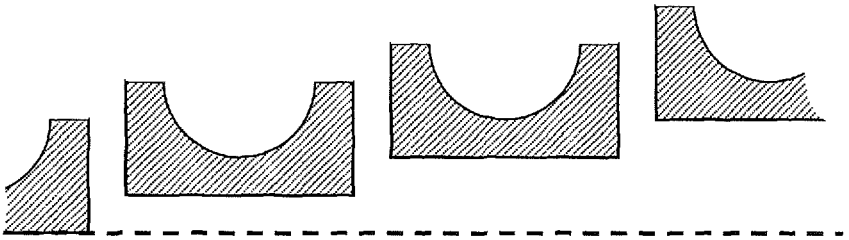
fig. 6b
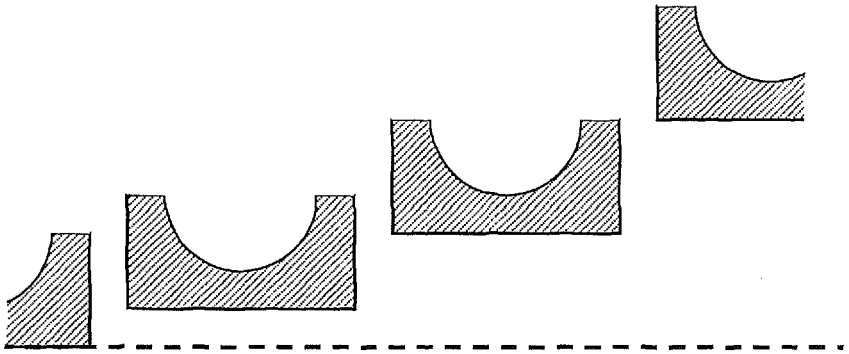
fig. 6c
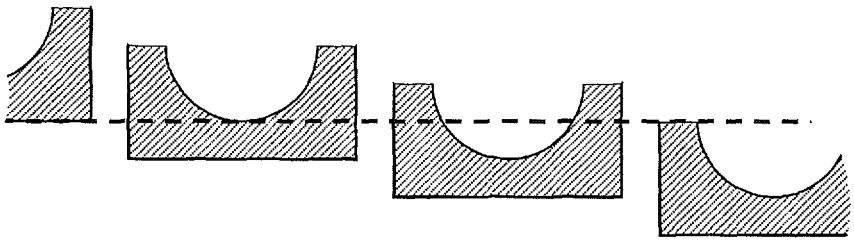
fig. 6d
fig. 6

DOUBLE DRUM TRACTION WINCH

CROSS REFERENCE TO RELATED APPLICATIONS

This application is the National Phase of PCT/NL2012/050264 filed on Apr. 19, 2012,which claims priority under 35 U.S.C. 119(e) to U.S. Provisional Application No. 61/478,267filed on Apr. 22, 2011, all of which are hereby expressly incorporated by reference into the present application.

The present invention relates to a double drum traction winch, to the use of such a double drum traction winch, to a vessel provided with such a traction winch, and to a method for using such a traction winch.

Double drum traction winches are known in the art. They typically comprise a frame supporting a first and second rotatable drum such that a wire can be wound about the two drums, and further comprise one or more drives for rotating both drums about their respective rotational axis. The circumferential surface of each drum is provided with parallel circumferential grooves extending perpendicular to the rotational axis of the drum, for, when in use, engaging the wire that is wound about both drums.

In most embodiments, the rotational axis of the first drum is tilted relative to the rotational axis of the second drum such that a circumferential groove of the second drum guides a wire wound about both drums from a first circumferential groove on the first drum to a second circumferential groove on the first drum.

The tension in the wire wound about both the drums, more in particular carried by the grooves provided in the outer surface of each drum, increases with each groove it passes through from a low tension end of a drum, where tension in the carried wire is low, towards a high tension end of a drum, were the tension in the carried wire is high.

The invention furthermore relates to vessel mounted traction winches, and the application of such a winch to off-shore technologies, e.g. for abandonment and recovery applications, oceanography, dredging at great depths, or to towing of large floating loads by tow boats. Such traction winches are used for taking in and letting out elongated bodies such as cables or wires, umbilical's, or the like. In particular, the invention relates to winches intended to haul very heavy loads and/or loads at great depths by means of a cable. In these situations a not inconsiderable part of the load is often constituted by the weight of the wire, the wire having a large diameter and very great length. Therefore, for lifting and lowering loads at great depths, often synthetic wires are used because of their low weight compared to steel wires.

A problem of known traction winches is that wires wear rapidly. Under load the wire, in particular fibre rope, stretches, which causes the wire to slip. The stretching of the wire and the subsequent slip of the wire along the surface of the drum causes heat development such that the temperature of the wire rises and thus results in increased wear of the wire. This is in particular disadvantageous for high-tech wires, more in particular for synthetic wires, which are more susceptible to heat development than steel wires.

It is an object of the present invention to provide an alternative double drum traction winch. It is a further object of the invention to provide a double drum traction winch that at least reduces slippage of the wires over the drum due to elongation of the wire, preferably essentially eliminates slippage of the wires over the drum due to elongation of the wire.

The invention therefore provides a double drum traction winch. With a double drum traction winch according to the invention the rotatable drums are both provided with adjustable grooves for carrying the wire. By adjusting the circumference of the grooves, the grooves of a winch according to the invention can be adapted to meet the shortening or elongation of the wire carried by the traction winch. Thus, the drums fit the wire and slippage of the wire is reduced or even eliminated.

Each of the drums of a double drum traction winch according to the invention comprises a core body, multiple curved segments, and an actuator mechanism.

The core body of each drum is mounted in the frame of the traction winch. One or more drives, e.g. an electric drive or an hydraulic drive, are provided for rotating the core body about its rotational axis, i.e. the rotational axis of the respective drum.

The multiple curved segments each define a section of a circumferential groove, such that each circumferential groove extends over several curved segments, for example over three or more curved segments. The curved segments are each movably supported on the core body for movement in a substantial radial direction relative to the rotational axis of the drum.

The actuator mechanism for the curved segments comprises actuators that cause essentially radial displacement of the curved segments. More in particular, the actuators allow a) moving curved segments into an outward position to increase the circumference of the grooves, and b) moving curved segments into an inward position to reduce the circumference of the grooves. The curved segments can be moved between their inward and outward position to adjust the grooves, more in particular the segments composing the grooves, in a radial direction, and to thus adjust the circumference of the grooves The actuator mechanism furthermore allows the curved segments to be positioned such that the circumference of a groove at the low tension end of the drum is smaller than the circumference of a groove at the high tension end of the drum.

Thus, the circumference of the grooves supporting the wire can be adapted such that the grooves have a small circumference where the elongation of the wire is low and have a large circumference where the elongation of the wire is high. In this way the drums can be adjusted to meet the changes in length of the wire, for example due to lifting or lowering a load.

Therefore, the drums can be adapted not only to fit the tensional properties of a particular type of wire, but also to fit the combination of a particular type of wire and a particular load to be supported using that wire.

With a prior art traction winch an increase or decrease in length of a wire, typically caused by the weight of the load supported with that wire, causes elongation or shortening of the wire and thus slip of that wire over the surface of the drum.

In an embodiment, a double drum traction winch according to the invention comprises a circumferential groove that is composed out of at least three, for example four, five, eight, or more curved segments. By thus providing multiple curved segments along the perimeter of the drum, the adjustment of the circumference of the grooves can be controlled better. Providing three or more curved segments to form a single groove furthermore facilitates adjusting the circumference of a groove while that groove is carrying a wire. Due to the lay out of a typical double drum traction winch, only part of the both drums carries a wire, while part of the drum, i.e. the part of the drum facing the other drum, does not carry a wire.

When the grooves are each composed out of three or more, even sized, segments, a drum can be rotated such that two of the curved segments carry the wire while the third segment faces the other drum and does not carry a wire. Thus, the circumference of the curve can be adjusted by moving the segment not carrying a wire, i.e. the segment facing the other drum, in the radial direction. Because the curved segment does not support a wire, less force is needed to move it, and thus it can be moved more easily. By rotating the drum the position of the three curved segments can be adjusted successively, more in particular, each segment can be moved in a radial direction when the segment is not supporting a wire.

In an embodiment, the actuator mechanism of a double drum traction winch according to the invention is provided with a mechanical and/or electronic control system adapted to operate the actuators while the drums carry a wire, in an embodiment while the drums carry a wire and are rotated, such that a curved segment is moved in the substantial radial direction only when the groove section of that curved segment only partially carries a wire, in an embodiment is moved only when the groove section of that curved segment does not carry a wire. The grooves can thus be adjusted when the traction winch is in use, more in particular when carrying a wire, even while lifting or lowering a load with that wire. Moving the segments only when not supporting a wire facilitates adjusting the groove because less force is needed for moving the segment when it is not supporting a wire.

Thus, the invention does provide not only a double drum traction winch of which the grooves of each drum, more in particular the circumferential length or radius of the grooves, can be adapted to the particular properties of the wire to be carried by the drums and to the influence of a particular load on that wire. The invention also provides a double drum traction winch that can be adapted when the load changes during use. The traction winch is thus particular suitable for lifting and lowering loads to great depths.

For example, with the same type of wire, the tension in the wire, and thus the elongation of the wire, is higher when lifting a heavy load and lower when lifting a lighter load. Also, when lifting and lowering loads from or to great depths respectively, the load supported by the wire wound about the winch changes due to the changes in the length of wire hanging down from the winch towards the load. The weight of the wire hanging down adds to the load supported by that wire. Thus, for example, when lowering an object to a great depth, a significant part of the supported load is formed by the weight of the section of the wire hanging down to support the object.

In an embodiment, the curved segments forming a groove are each at one end shaped for supporting an overlying end of an adjacent curved segment, and at the opposite end are each shaped for engaging a curved segment for support, such that the curved segments forming a groove support each other like overlapping members or roof tiles. Thus, the curved segments together form a robust but adjustable outer surface of the drum.

In an alternative embodiment, each grove is formed by an even number of curved segments, of which half of the curved segments are at both ends provided with supporting ends, shaped for supporting an overlying end of an adjacent curved segment. The other half of the curved segments are at both ends provided with overlying ends, shaped for slideable engaging a supporting end of the supporting curved segment for support. Thus, the second half of curved segments is supported by the first half of curved segments. By moving the supporting curved segments in a radial direction, the supported curved segments are moved as well. To allow for adjustment of the radial circumference of the groove formed by the curved segments, the segments slideably engage each other, such that in addition to moving in a radial outward direction they can slide away from each other and in addition to moving in a radial inward direction they can slide towards each other, to respectively increase or reduce circumference, i.e. the length, of the groove.

In an embodiment, the curved segments forming the parallel grooves of the drums of a double drum traction winch according to the invention are arranged parallel in rows along the longitudinal axis of the drum and the actuator mechanism comprises actuators common to such a row of curved segments for moving one or more curved segments of multiple grooves simultaneously. Thus, the curved segments of such a row, and thus the circumference of multiple grooves, can be adjusted quickly and simply. Using a single actuator for moving multiple curved segments allows for a simplified design.

In a further embodiment according to the invention, each common actuator comprises a cam shaft supported by the core body of the respective drum, the camshaft extending in a direction parallel to the rotational axis of the drum, each cam shaft interacting with a row of curved segments for simultaneous movement in the substantial radial direction of the multiple curved segments by rotating the cam shaft. Thus, the position of the curved segments of multiple grooves can be adjusted efficiently and at the same time.

In an embodiment, the cam shaft is provided with a separate cam for each segment, which cam is supported in an opening provided in the segment. The cams thus prevent substantial movement of the segment in the circumferential direction.

In an embodiment, the actuator is designed to move the curved segments of adjacent grooves over different radial distances, such that the circumference of a first groove is adjusted to a lesser extend than the circumference of a groove adjacent to the first groove and located at the high tension side of the first groove. The difference of adjustment is beneficial since the tension in the wire differs per groove, and thus the elongation of the wire also differs per groove, more in particular increases towards the high tension side of the drums. The circumference of the grooves preferably substantially matches the changes in elongation of the wire due to the increase of tension in that wire with each groove.

In a further embodiment, the actuator mechanism of a double drum traction winch according to the invention is adapted for moving the curved segments of a drum at a predetermined and fixed ratio from one groove to the next groove to adjust the circumferential distance of each groove in relation to a predetermined, possibly non-linear, elastic behaviour of the wire. Thus, the change in the circumference of the grooves matches the elongation of that type of wire in ach particular groove. The drums of the traction winch are thus be optimally configured for use with that particular type of wire.

In an embodiment, the actuator mechanism of a double drum traction winch according to the invention is provided with a control system comprising one or more sensors for detecting the wire speed and/or tension in the wire carried by the drum. This control system is adapted to operate the actuators such that the segments are positioned in dependence of the actual tension in, and thus the stretch of, the wire for forming grooves having a circumferential length such that the surface of the curved segment carrying the wire has substantially the same speed as the wire.

For example, the sensors can be combined with a pulley system for guiding the wire towards or away from the traction winch for sensing the tension in the wire, or be combined with the curved segments forming the grooves, for sensing the pressure exerted by the wire on the curved segments and/or the friction between the wire and the curved segments and/or the speed of the wire relative to the curved segment. This sensor data is used by the control system to optimally position the curved segments to minimize slip.

In an embodiment according to the invention, the core body supports at fixed angularly spaced locations cam shafts that extend parallel to and at equal radial distance from the rotation axis of the drum. In a further embodiment, of a first row of curved segments each curved segment has a first end cooperating with a first cam shaft to displace said end substantially in radial direction and each curved segment of the first row has a second end that is supported by a first end of a segment of an adjacent second row of curved segments, and a second cam shaft cooperates with said first ends of the segments of the second row to displace said first ends of the curved segments of the second row, and thus the second ends of the curved segments of the first row, in said radial direction.

Thus, the segments can be moved efficiently, and can be easily positioned relative to each other at the same time.

In a further embodiment according to the invention, for each cam shaft a cam shaft actuator is provided on the core body, e.g. a hydraulic or electric motor. In an embodiment, said cam shaft actuators are operable independent from one another to allow adjustments of the segments that not carry a wire while the segments that do carry a wire are not adjusted. This facilitates adjusting the grooves during use of the winch, i.e. while the winch is supporting a wire and optionally is lifting or lowering a load.

In a further embodiment, each curved segment is provided with its own actuator, for example a bar system actuated by a hydraulic cylinder or a cam wheel operated by an electric drive, for moving that segment in the substantially radial direction. This allows for individual adjustment of the segments and thus for adjusting the grooves to different types of wires and/or unexpected changes in tensional behaviour of a wire.

The invention furthermore provides the use of a double drum traction winch according to the invention in off-shore operations, for example for abandonment and recovery applications, oceanography, dredging at great depths, or for towing by a tow boat.

The invention furthermore provides a vessel provided with a double drum traction winch according to the invention.

The invention furthermore provides a method for reducing wire slip on a double drum traction winch. The method comprising the steps of:

Providing a double drum traction winch according to the invention;

Providing a storage drum with a wire to be carried by the double drum traction winch;

Adjusting the radial position of the curved segments and thus adjusting the circumferential length of grooves defined by those curved segments;

Guiding the wire from the storage drum to the traction winch, winding the wire about the two traction drums such that the wire is carried by the grooves;

Guiding the wire from the traction winch to a load, and connecting the wire with the load;

Lifting or lowering the first load using the traction winch and the wire.

A further method according to the invention comprises the step of adjusting the circumference of multiple grooves, in an embodiment simultaneously, by adjusting the radial position of multiple curved segments, while the drums are carrying the wire. In an embodiment, the position of the curved segments is adjusted per row of curved segments, said row extending in a direction parallel to the rotational axis of the drum.

The grooves can thus be adjusted while the traction winch is supporting a wire, and while the wire is supporting a load.

A further method according to the invention comprises the step of dynamically adjusting the circumference of the grooves, in an embodiment simultaneously, by adjusting the radial position of multiple curved segments while the drums are rotated, and wherein a curved segment is moved in the substantial radial direction only when the groove of that curved segment only partially carries a wire, in an embodiment is moved only when the groove of that curved segments does not carry a wire.

The grooves can thus be adjusted while the traction winch is supporting a wire, while the wire is supporting a load, and while the drums are rotating, thus during the actual lifting or lowering of a load supported by that wire.

In a further embodiment, the position of the curved segments defining a groove is adjusted in a consecutive fashion along the circumferential distance of the groove. This facilitates adjusting the grooves, more in particular the circumference of the grooves, while the drum is rotated.

Further embodiments of the invention as well as the advantages and essential details thereof are disclosed in the drawing and the description and the claims which follow.

The invention will be explained in more detail with reference to the drawing, in which:

FIG. 5 shows a partial top view in cross section of the traction winch of FIG. 1, in which two outer sides of the drums, i.e. the sides of the drum carrying a wire, are shown in cross section; and FIG. 6 shows a schematic view of some curved segments in cross section at different positions.

FIG. 1 shows a top view of a double drum traction winch 1 according to the invention. FIG. 2 shows a frontal view of the same traction winch.

Figure 1:
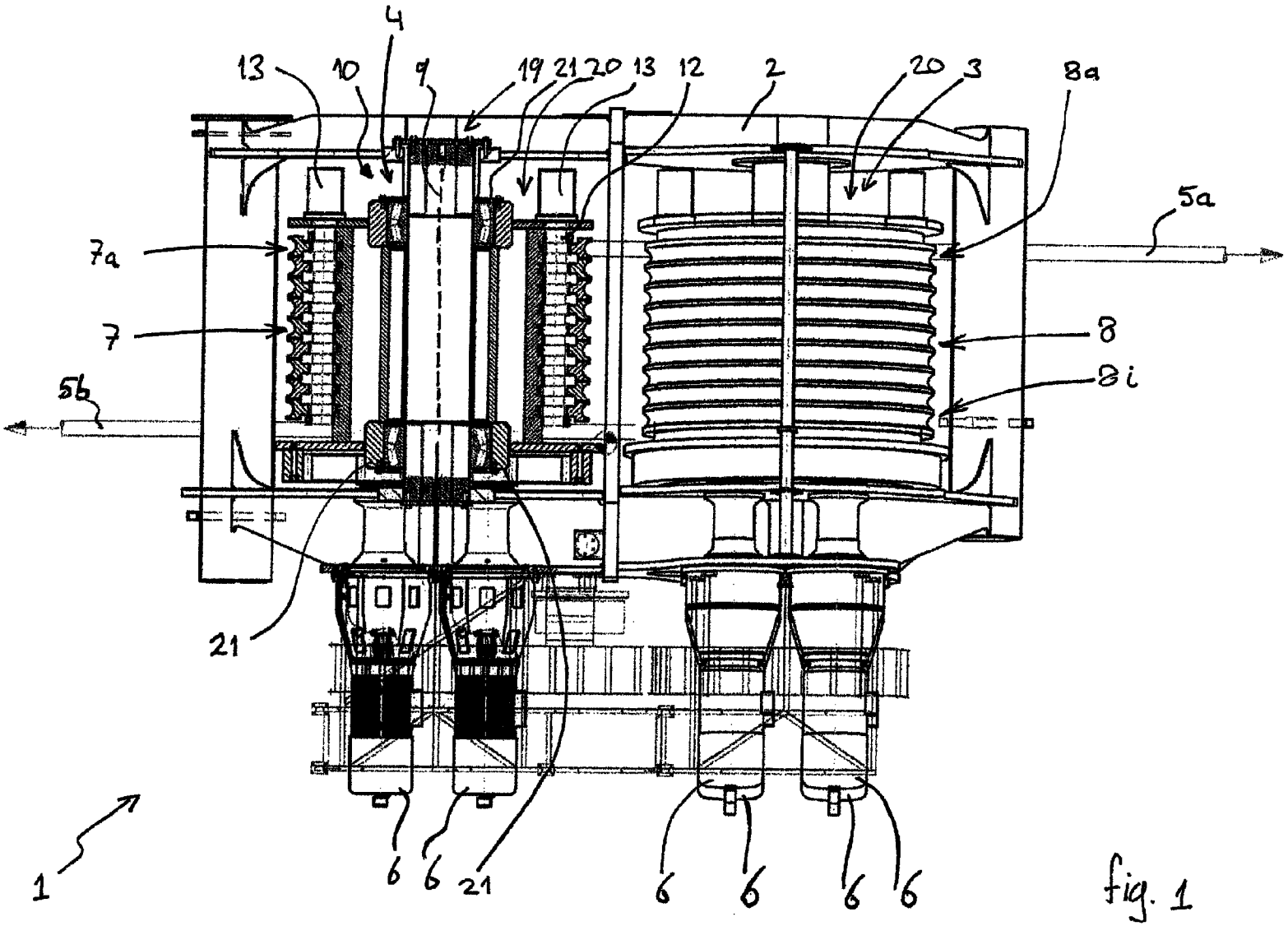
FIG. 1 shows a top view, partially in cross section, of a double drum traction winch according to the invention.

The double drum traction winch 1 comprises a frame 2 supporting a first rotatable drum, or afterward drum 3 and a second rotatable drum, or forward drum 4. In the figure the left drum 4 is shown in cross section. With the traction winch in use, a wire is wound about the two drums. For clarity reasons the wire 5 is not fully shown in these figures, only the sections extending to and from the winch are depicted in FIG. 1. It is observed that a skilled person is known with the general working principles of a double drum traction winch and with the way a wire is carried by such a winch. This will therefore not be extensively discussed.

In the embodiment shown, the first drum 3 is located near a storage drum (not shown) from which the traction winch receives the wire 5, of which part 5*a* is shown in the figure. The wire passes below the first drum 3, without touching it, towards the second drum 4. On the second drum 4 it is received in a first groove 7*a* and guided about the drum, back towards the first drum 3, about which it is guided by a first groove 8*a* back towards a second groove on the second drum, etc. In the embodiment shown the part of the wire 5 is guided from the last groove 8*i* of the first drum down below the second drum, without touching it, towards the load supported by the wire 5. Thus, the wire makes 9 turns about the two drums, passing eighteen grooves, 9 per drum, in total.

In the embodiment shown, the rotational axis of the first drum is tilted relative to the rotational axis of the second drum such that a circumferential groove of the second drum guides a wire wound about both drums from a first circumferential groove on the first drum to a second circumferential groove on the first drum. By thus positioning the drums, the wires can be transferred between the drums over a short distance, i.e. the drums can be positioned close together, without extensive bending of the wires and/or extensive friction between the flanges of the grooves and the wires.

Figure 2:
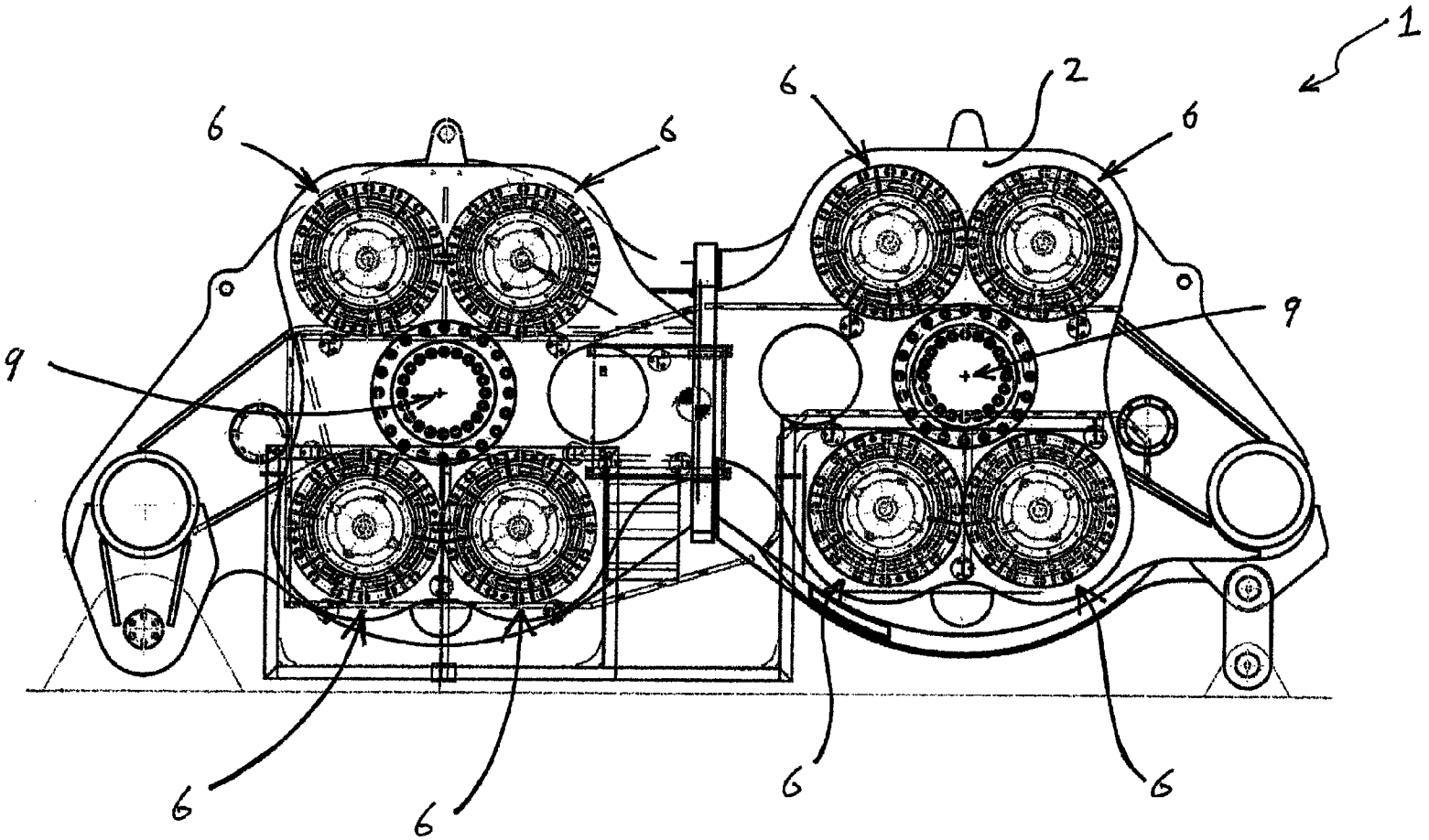
FIG. 2 shows a frontal view of the traction winch of FIG. 1.

It is observed that the invention can be used with types of winches that differ form the one shown in FIGS. 1 and 2, for example winches having another configuration, different number of grooves and/or turns as well as different configurations for guiding of the wire towards and from the drum, etc.

The rotatable drums 3,4 each comprise a core body 10, mounted in the frame 2 for rotation about the rotational axis 9 of the drum by drives. More in particular, a main shaft 19 is provided for each drum, on which a drum body 20 is mounted via roller bearings 21. The double drum traction winch 1 shown comprises multiple drives 6 for rotating the drums about their respective rotational axis. In the particular embodiment shown, both drums are provided with four drives. Other configurations are possible and are not considered inventive in view of the prior art.

The outer surface of each drum is provided with parallel circumferential grooves 7, 8 perpendicular to the rotational axis 9 of the respective drums for, when in use, carrying the wire that is wound about both drums.

It is observed that normally a wire between the storage winch and the winch is already under tension, so called back tension, to initiate grip of the wire on the surface of the drum of the traction winch. The tension in the wire 5 carried by the grooves increases with each groove it passes through, from a low tension end of a drum, where tension in the carried wire is low, towards a high tension end of a drum, were the tension in the carried wire is high. Typically, tension in the wire is lowest in the first groove of the winch, receiving the wire form the storage drum, and highest in the last groove of the winch, from which it is guided towards the load.

Thus the low tension ends of the drums are typically those at the side of the winch where the wire is fed from the storage winch to the traction drum, in the top view in FIG. 1 the upper ends, and the high tension ends of the drums are those at the side of the winch where the wire is fed towards the load, in the top view in figure one the lower ends. This is also shown in FIG. 5 in which the load distribution along the grooves of the drums is indicated for a typical load.

FIG. 5 shows a top view in cross section of the two outer sides of the drums, i.e. the sides of the drum carrying a wire, of the traction winch of FIG. 1. For example, in the particular embodiment shown in FIG. 5, the load distribution along the grooves of the drums, i.e. the development of the tension in a particular wire carried by the grooves, for a typical load is as follows.

The wire on the first groove 7*a* of drum 4 is subjected to a linepull of 600-667 kN. When the wire enters the groove, the tension in the wire, the so called back pull, is 600 kN. When the wire leaves the groove, the tensions has increased to 667 kN. The linepull in the first groove 8*a* on drum 3 is 667-741 kN. The line pull in the subsequent groove on drum 4 is 741-823 kN. The linepull in the subsequent groove on drum 3 is 823-915 kN. The line pull in the subsequent groove on drum 4 is 915-1016 kN. The linepull in the subsequent groove on drum 3 is 1016-1129 kN. The line pull in the subsequent groove on drum 4 is 1129-1255 kN. The linepull in the subsequent groove on drum 3 is 1255-1394 kN. The line pull in the subsequent groove on drum 4 is 1394-1549 kN. The linepull in the subsequent groove on drum 3 is 1549-1721 kN. The line pull in the subsequent groove on drum 4 is 1721-1913 kN. The linepull in the subsequent groove on drum 3 is 1913-2125 kN. The line pull in the subsequent groove on drum 4 is 2125-2362 kN. The linepull in the subsequent groove on drum 3 is 2362-2624 kN. The line pull in the subsequent groove on drum 4 is 2624-2916 kN. The linepull in the subsequent groove on drum 3 is 2916-3240 kN. The line pull in the subsequent groove on drum 4 is 3240-3600 kN. The linepull in the last groove 8i on drum 3 is 3600-4000 kN. Thus, the line pull of the wire on the traction winch is over the traction winch gradually increased from 600 kN to 4000 kN.

The low tension ends of the drums are typically those at the side of the winch where the wire is fed from the storage winch to the traction drum, in the top view in FIG. 1 the upper ends, and the high tension ends of the drums are those at the side of the winch where the wire is fed towards the load, in the top view in FIG. 1 the lower ends.

However, it is observed that which end of the drum is the low tension end, and which end of the drum is the high tension end, may change due to the loading of the drum, more in particular to the load supported by the wire and the tension in the wire fed to the drum from a storage winch.

For example when the carried wire does not support a load the tension in the wire between load and winch may be lower than the tension in the wire between storage drum and winch. In this situation it is possible that the tension in the wire in the last groove of the winch, located at the high tension end of a drum, is smaller than the tension in the wire in the first groove of the winch, located at the low tension end of a drum.

Figure 3:
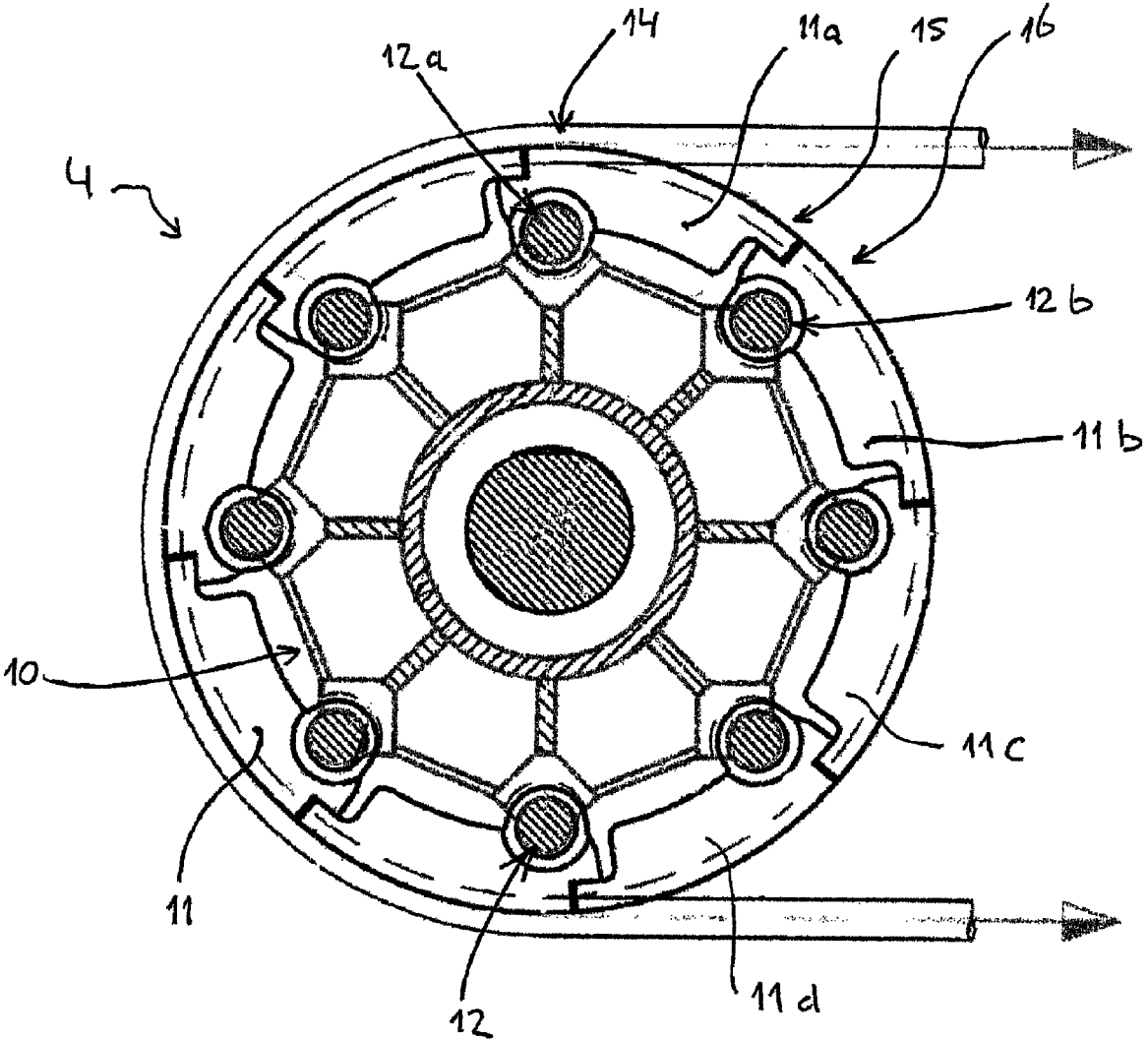
FIG. 3 shows a frontal view in cross section of a drum of the traction winch of FIG. 1.
Figure 4:
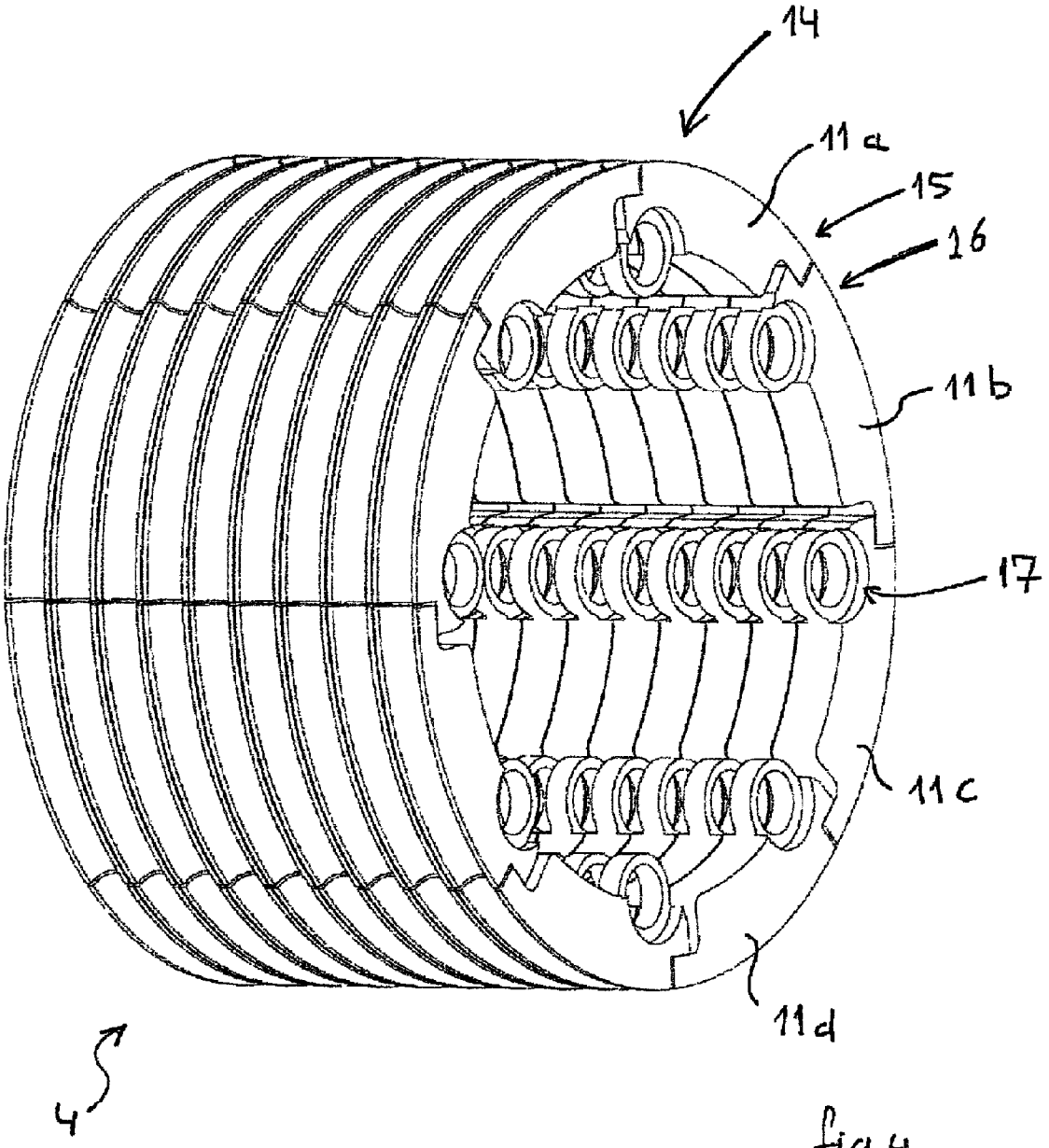
FIG. 4 shows a perspective view of curved segments of a drum of the traction winch of FIG. 1.

The rotatable drums 3, 4 of the traction winch 1 according to the invention are drums with adjustable grooves 7,8. The drums comprise multiple curved segments 11, each segment defining a section of a circumferential groove, such that multiple circumferential grooves of the drums are each composed of several curved segments. These curved segments are shown in FIG. 3 in a frontal view in cross section of a drum according to the invention shown. Furthermore, FIG. 4 shows the curved segments of a drum according to the invention in perspective view.

The curved segments 11 comprise a support body at the side facing towards the drum, and a groove for carrying a wire at their opposite side. In the embodiment shown, the curved segments 11 are furthermore provided with a circular opening 17 for receiving a camshaft supporting the curved segments. By connecting the curved segment to the cam shaft via the circular opening the cam shaft does not only support the curved segment in a radial direction, forces directed alternative directions, for example in a tangential direction, can also be transferred from the curved segment to the drum and the frame of the traction winch.

In the particular embodiment shown each drum comprises eight parallel rows of nine curved segments. The curved segments together form nine circumferential grooves on the outer surface of the drum. Each groove is formed by eight curved segments.

The curved segments 11 are each movably supported on the core body of the drum for movement in a substantial radial direction relative to the rotational axis of the drum. The substantially radial direction is indicated in FIG. 3 for one row of curved segments with double arrow 18.

An actuator mechanism is provided for the curved segments 11. The actuator mechanism comprises actuators that cause essentially radial displacement of the curved segments. In the embodiment shown, the core body 10 of the drums 3,4 supports at fixed angularly spaced locations cam shafts 12 that extend parallel to and at equal radial distance from the rotation axis 9 of the respective drums. The cam shafts are rotated with drives 13, mounted on the side of the drums.

With the actuator mechanism according to the invention, the curved segments 11 can be moved into an outward position to increase the circumference of the grooves 7,8, and into an inward position to reduce the circumference of the grooves 7,8. In the particular embodiment shown, the curved segments 11 are in contact with cams of the cam shafts 12 such that by rotating the camshafts the curved segments are moved in the radial direction.

In the embodiment shown, the curved segments are arranged parallel in rows along the longitudinal axis of the drum and the actuators of the actuator mechanism are common to such a row of curved segments. Thus one actuator can move a row of curved segments simultaneously. In an alternative embodiment one actuator is provided for a set of grooves, for example for each set of curved segments forming a groove, or each curved segment is provided with a separate actuator for individually positioning the curved segments.

It is observed the in practice the trajectory of radial displacement of the curved segments is small compared to the diameter of the drum. For example, a drum having a diameter of 2.6 meters can be provided with curved segments that can be moved in the radial direction over a trajectory of 15 mm. In general, a relative small displacement of the curved segments will be sufficient to cope with the elongation of the wires used.

Furthermore, the drum can be configured such that the curved segments at the high tension end of a drum can be moved in the radial direction over a larger trajectory than the curved segments on the low tension end of the drum or visa versa. Also it is possible to provide the drum with adaptable grooves only, or with some fixed grooves, i.e. non adaptable, and some adaptable grooves. In an embodiment only one groove of the set of drums is not adjustable, i.e. the groove that receives the wire from the storage drum or the groove from which the wire is fed to the load.

In an embodiment according to the invention, elongation in the wire carried by the drums is met by increasing the diameter of the grooves. With an increase in tension the elongation of the wire increases. Since the tension in the wire increases along the drum, the diameter of the grooves of the drum in an embodiment increases per groove from the low tension end of the drum towards the high tension end of the drum. Thus, the drums are provided with a treaded surface formed by grooves of increasing diameter. Due to the increase in groove diameter, the circumferential length of the grooves increases and the increase in length of the wire is met. The elongation of the wire leads to an increase in the speed of the wire towards the high tension end of a drum. Slip of the wire along the surface of the drum, more in particular in the grooves, is substantially prevented since the diameter of the groves increases towards the high tension end of the drum, and thus the speed of the surface of the drum increases towards the high tension end of the drum.

In addition to moving the curved segments into an inward and outward position, the actuator mechanism according to the invention allows the curved segments to be positioned such that the circumference of a groove at the low tension end of the drum is smaller than the circumference of a groove at the high tension end of the drum.

This treaded surface can be obtained by reducing the circumference of the grooves towards the low tension end of the drum, by increasing the circumference of the grooves towards the high tension end of the drum, or by a combination of both. With the latter solution, the diameter of the grooves at the low tension end of the drums is reduced, and at the high tension end of the drums is increased.

In the particular embodiment shown in FIGS. 1 and 2, the actuator mechanism is provided with cams of increasing size along each camshafts supporting the curved segments. Thus, by rotating the cam shaft, the drums can be provided with a treaded surface formed by grooves having an increasing diameter.

In the particular embodiment shown, the cams are shaped such that the curved segments can also be positioned in an initial position in which all grooves on a drum have the same diameter. This position is shown in the top view in FIG. 1.

In the particular embodiment shown, the actuator mechanism is configured for moving the curved segments at the low tension end of the drums inward, and thus to reduce the diameter of the grooves at the low tension ends of the drums, to meet elongation of the wire under increased tension.

Shown in figure. 5, is a top view in cross section of the two outer sides of the drums of the traction winch of FIG. 1. It is observed that the grooves are shown in an initial position, in which they all have the same diameter. In use, the radius of the grooves towards the low tension end will be reduced, to match the tension in the wire, such that the radius of the grooves in the direction from the high tension end to the low tension end of the drum gradually reduces.

For example, in the embodiment shown in FIG. 5, the trajectory of displacement of the curved segments is as follows.

The curved segments of the first groove 7*a* of drum 4 can be moved in the radial direction over a distance of 15 mm. The curved segments of the first groove 8*a* of drum 3 can be moved in the radial direction over a distance of 14.67 mm. The curved segments of the subsequent groove of drum 4 can be moved in the radial direction over a distance of 14.30 mm. The curved segments of the subsequent groove of drum 3 can be moved in the radial direction over a distance of 13.89 mm. The curved segments of the subsequent groove of drum 4 can be moved in the radial direction over a distance of 13.44 mm. The curved segments of the subsequent groove of drum 3 can be moved in the radial direction over a distance of 12.93 mm. The curved segments of the subsequent groove of drum 4 can be moved in the radial direction over a distance of 12.37 mm. The curved segments of the subsequent groove of drum 3 can be moved in the radial direction over a distance of 11.74 mm. The curved segments of the subsequent groove of drum 4 can be moved in the radial direction over a distance of 11.05 mm. The curved segments of the subsequent groove of drum 3 can be moved in the radial direction over a distance of 10.27 mm. The curved segments of the subsequent groove of drum 4 can be moved in the radial direction over a distance of 9.41 mm. The curved segments of the subsequent groove of drum 3 can be moved in the radial direction over a distance of 8.46 mm. The curved segments of the subsequent groove of drum 4 can be moved in the radial direction over a distance of 7.40 mm. The curved segments of the subsequent groove of drum 3 can be moved in the radial direction over a distance of 6.21 mm. The curved segments of the subsequent groove of drum 4 can be moved in the radial direction over a distance of 4.90 mm. The curved segments of the subsequent groove of drum 3 can be moved in the radial direction over a distance of 3.44 mm. The curved segments of the subsequent groove of drum 4 can be moved in the radial direction over a distance of 1.81 mm. The curved segments of the subsequent groove of drum 3 can be moved in the radial direction over a distance of 0.00 mm. The curved segments can thus be adjusted to compensate for any elongation of the wire due to increased tension, and thus prevent slippage of the wire over the surface of the drum, more in particular slippage in the respective grooves.

In an embodiment, the curved segments of a double drum traction winch according to the invention are each at one end shaped for supporting an overlying end of an adjacent curved segment, and at the opposite end are each shaped for engaging a curved segment for support, such that the curved segments forming a groove support each other like overlapping roof tiles. Such an embodiment is shown in the figures, in particular in FIGS. 3 and 4.

In the particular embodiment shown, a first row of curved segments 11*a* each have a first end 14 of a curved segment 11 cooperating with a first cam shaft 12*a* to displace said end substantially in an essentially radial direction. Each second end 15 of a segment of the first row 11*a* is supported by a first end 16 of a segment of an adjacent second row 11*b*. A second cam shaft 12*b* cooperates with said first ends 15 of the segments of the second row 11*b* to displace the ends in the radial direction. Thus, by actuating a single cam shaft the ends of the segments of two rows adjacent rows are moved. Thus, the curved segments can be moved efficiently.

In the embodiment shown, for each cam shaft a cam shaft actuator is provided on the core body, e.g. a hydraulic or electric motor. The cam shafts can thus be rotated individually. Alternatively, one cam shaft actuator is provided for rotating two or more cam shafts. In a further embodiment, said cam shaft actuators are operable independent from one another.

In an embodiment, the actuator mechanism is provided with a control system adapted to operate the actuators while the drums carry a wire. Thus, the drums can be adjusted when the tension in the wire changes, for example when a load is attached to one end of the wire. IN a further embodiment, the actuator mechanism is provided with a control system adapted to operate the actuators while the drums carry a wire and while the drums carrying a wire are rotated. Thus, the drums can be adjusted for example while a load is being lifted or lowered. In a further embodiment, the actuator mechanism is provided with a control system adapted to operate the actuators while the drums carry a wire and are rotated and such that a curved segment is moved in the substantial radial direction only when the groove section of that curved segment only partially carries a wire, in an embodiment is moved only when the groove section of that curved segments does not carry a wire.

For example in the side view in cross section of the drum shown in FIG. 3, two curved segments 11*a*, 11*d* partially carry a wire and two curved segments 11*b*, 11*c*, both facing the other drum, do not carry a wire. When lowering a load, the drum 4 is rotated in a clockwise direction. Thus, the curved segments come free from the wire at the top side of the drum, and engage the wire at the bottom side of the drum. When adjusting the position of the curved segments, they are preferably moved when they are not carrying a wire, in this case curved segments 11*b* and 11*c*. However, it is also possible for segment 11*d* to already move the end of the curved segment free from wire, while the opposite end of the cured segment still carries a wire. By moving the curved segment, or part of the curved segment, when not carrying a wire, the drives for rotating the cam shaft supporting that curved segment, or part of that curved segment, do not need excessive power and can thus be kept comparatively small in size and light of weight.

In a further embodiment, for adjusting the circumference of a groove a first curved segment is moved at one end only, to form an intermediate between the curved segments defining the previous circumference and the curved segments defining the new circumference. When the circumference of the groove is to be adjusted, for example increased, of a first curved segment the upstream end, i.e. the end firs engaging the wire, is not moved in the radial direction, and the downstream end, i.e. the end that engages the wire last is moved to a new radial position. Of the subsequent curved segment both ends are moved to a new radial position. Thus, the first curved segment forms an intermediate between the old and new circumference, and guides the wire onto the second curved segment which is moved at both ends into the new radial position. By thus adjusting the circumference of the groove and thus guiding the wire, peak tensions in the wire due to sudden changes in the diameter of the groove are prevented.

In an embodiment, the actuator mechanism is provided with a control system comprising one or more sensors for detecting the wire speed and/or tension in the wire carried by the drum. This control system is furthermore adapted to operate the actuators such that the segments are positioned in dependence of the actual tension in, and thus the stretch of, the wire for forming grooves having a circumferential distance such that the surface of the curved segment carrying the wire has substantially the same speed as the wire. Such a control system allows for automatic adjustment of the position of the curved segments while lifting and/or lowering a load, in particular when the supported load changes during the lifting or lowering operation, for example when lifting and/or lowering a load at great depths.

It is observed that in the embodiment shown the curved segments are positioned such that the radii of the grooves are similar. In use the radii of adjacent curves will differ, with the groove having the smallest radius located at the low tension end of the drum and the groove having the largest radius located at the high tension end of the drum. Thus, the curved segments of a groove can be moved between an inward position for supporting a wire under low tension, and an outward position for supporting a wire under high tension. The minimal inward and maximal outward position are similar for the curved segments forming a groove, but may differ between curved segments forming adjacent grooves.

It is observed that the elastic behaviour of different types of wires differs, due to for example the material(s) used, the weave of the wire and the diameter of the wire. Some wires have a linear elastic behaviour in their entire operational window, others have a non linear elastic behaviour, and others have a linear elastic behaviour along a part of their operational window, for example when supporting light loads, and a non linear elastic behaviour along another part of their operation window, for example when supporting large loads. In an embodiment, the actuators are configured such that the movement of the curved segments is linked to the elastic behaviour of a typical type of wire.

In an embodiment the actuator mechanism is adapted for moving the curved segments of a drum at a predetermined and fixed ratio from one groove to the next groove, to adjust the circumferential distance of each groove in relation to the elastic behaviour of the wire. Thus, the speed at which the curved segment at the high tension end of the drum is moved is higher than the speed of the curved segment at the low tension end of the drum. All segments are thus moved into their next position in the same amount of time. This may for example be achieved by providing a cam shaft with off centre and circular shaped cams.

It is furthermore observed that the stretching behaviour of a wire may not be direct proportional to the tension in the wire along its entire operation window. Thus, when the overall tension in the wire increases, the ratio between the radii of the different grooves may change. In a further preferred embodiment, the actuator mechanism is adapted for moving the curved segments of a drum at a predetermined and changing ratio from one groove to the next groove to adjust the circumferential distance of each groove in relation to a predetermined non-linear elastic behaviour of the wire. Thus, the speed at which a curved segment is moved from the inward position towards the outward position, or visa versa, may differs in relation to the tension in the wire. This may for example be achieved by providing a cam shaft with oval shaped cams.

By using a traction winch according to the invention wire slip on a double drum traction winch can be reduced or even eliminated.

In use, the traction winch is preferably combined with a storage drum holding a wire to be carried by the double drum traction winch. In an embodiment, the radial position of the curved segments is adjusted, and thus the circumferential length of the grooves defined by those curved segments, to fit the specifics of the wire and or the load supported by the wire.

The wire is subsequently guided from the storage drum to the traction winch, and wound about the two traction drums such that the wire is carried by the grooves. The wire is then guided from the traction winch to a load, for example via a crane and/or pulley system, and connected to the load. The wire can then be used for lifting and/or lowering the load using the traction winch.

With a traction winch according to the invention the circumference of the grooves can be adapted by moving the curved segments forming the grooves in a substantial radial direction. Thus, the circumferences of the grooves are adapted to fit the particular wire and the load supported by that wire. Slippage between rope and the drum is thus prevented. This slipping of the wire develops heat and causes extensive wear, especially with synthetic, i.e. light weight, wires. Hence, with a double drum traction winch according to the invention it is possible to use lightweight rope in deep water, e.g. for lowering equipment and placing equipment on the bottom of the sea. By enabling the use of light weight wires the traction winch according to the invention enables an increase in loads to be carried by that wire and/or the water depths to be reached since the part of the load formed by the weight of the wire is reduced. The traction winch according to the invention may alternatively be applied for mooring purposes.

In a method according to the invention, the circumference of multiple grooves is adjusted by adjusting the radial position of multiple curved segments, while the drums are carrying the wire. Thus the grooves, more in particular the radius and circumference of the grooves, are adapted while the wire is supporting a load. In an embodiment the radii of a row of grooves are adjusted simultaneously with an actuator common to the row of grooves.

A further method according to the invention comprises the step of dynamically adjusting the circumference of the grooves, in an embodiment simultaneously, by adjusting the radial position of multiple curved segments while the drums are rotated. A curved segment is in an embodiment moved in the substantial radial direction only when the groove of that curved segment partially carries a wire, in an embodiment is moved when the groove of that curved segments does not carry a wire. In this embodiment, the position of the curved segments defining a groove is adjusted in a consecutive fashion along the circumferential distance of the groove. Thus, the curved segments are moved when not, or at least not fully, supporting the wire, which facilitates adjusting the position of the curved segments. For adjusting the radius of a groove, and thus adjusting the position of all curved segments forming the groove, the drum has to rotate over a full 360 degrees.

With a traction winch according to the invention, an increase or decrease in length of a wire caused by the weight of the load supported by that wire is balanced by increasing or reducing the diameter of the grooves supporting the wire and thus extending or reducing the circumferential length of the grooves of the drums, i.e. extending or reducing the distance a wire travels about the drum. Thus the wire is optimal supported along the drum and slippage of the wire is at least reduced compared to a double drum traction winch known from the art.

Furthermore, in an embodiment according to the invention, the circumference of the grooves can be adjusted while lowering or lifting a load. The invention also provides dynamic adjustment of the circumference of the grooves. Thus, the circumference of the grooves can be adjusted while the grooves support a wire, and thus when the tension in the wire changes during lifting and lowering a load.

For example, when lowering an object to a great depth in off shore operations, the load supported by the wire continuously increases. While lowering the object, the length of the supporting wire, i.e. the distance between load and surface, increases, and thus the weight of the supported wire increases. Therefore, the tension in the wire section wound about the drums of the traction winch increases.

With a traction winch according to the invention, the circumference of the grooves can be adapted during the lowering of the load. Thus, the traction winch provides an optimal support for the wire, and prevents slip, for example during the whole trajectory of lowering and/or lifting an object.

A double drum traction winch according to the invention can be used in off-shore operations, for example for abandonment and recovery applications, oceanography, dredging at great depths, or for towing by a tow boat.

The traction winch according to the invention is beneficial since it enables handling any type of rope, e.g. lightweight rope, fibre rope and wires in a very careful manner, without causing damage. The use of fibre rope is particularly beneficial when large ends are required, e.g. for use in deep water, because of its properties being as strong as steel wire but only a fraction of the weight. This means that lightweight fibre rope can handle a substantially better payload in deep water, and, due to its low weight, winches and handling equipment may be applied with much smaller power requirements and dimensions than for steel wire. As a result, energy and space consumption of traction winches on offshore equipment is reduced.

In FIG. 6 the curved segments of adjacent grooves are shown in cross section. The figure is highly schematic and the relative movement of the curved segments is exaggerated for explanatory purposes. The wire supported in the grooves is not shown in the drawing.

FIG. 6*a* shows the curved segments in an initial position in which all the grooves have the same radius and circumference. Such a position of the curved segments is also shown in FIG. 1.

FIG. 6*b* shows a situation in which the curved segments towards the high tension end of the drum, i.e. the right in the figure, are moved in an outward position, i.e. upwards in the figure. It is observed that the same affect can be achieved by moving the curved segments towards the low tension end of the drum, i.e. the left in the figure, towards an inward position, i.e. downward in the figure.

FIG. 6*c* shows a situation in which the curved segments are moved in an outward position, similar to the situation depicted in FIG. 6*b*, but with more tension in the wire and thus more elongation of that wire. Thus, in the particular situation shown, the curved segments towards the high tension end of the drum are moved further outward for supporting the wire than the curved segments in the situation depicted in FIG. 6*b*.

FIG. 6*d* shows the curved segments in a situation in which the high tension end and the low tension end of the drum have switched. Such a switch may occur when the tension in the wire between the traction winch and storage drum is higher than the tension in the wire between the traction winch and the load, for example when a comparatively light load, or no load at all, is supported by the wire. In the depicted situation the tension in the wire is high enough to cause elongation of the wire, and the curved segments towards the low tension end of the drum, i.e. the right in the figure, are moved inward to provide the drum with grooves having a larger circumference towards the high tension end of the drum.

The invention claimed is:

1. A double drum traction winch comprising:

two rotatable drums including first and second rotatable drums;

a frame supporting the first and second rotatable drums such that a wire can be wound about the two rotatable drums, wherein the two rotatable drums each have a rotational axis and an outer surface; and one or more drives for rotating the first and second rotatable drums about their respective rotational axis, wherein each of the first and second rotatable drums comprises:

a core body, mounted in the frame for rotation about the rotational axis of the rotatable drum by said one or more drives;

a plurality of circumferential grooves formed on the outer surface, each of the plurality of circumferential grooves being defined by a plurality of curved segments movably supported on the core body for movement in a substantial radial direction perpendicular to the rotational axis of the rotatable drum, wherein the plurality of circumferential grooves extend parallel to each other and perpendicular to the rotational axis of the rotatable drum, for carrying the wire that is wound about both rotatable drums, and wherein in use, the tension in the wire carried by the plurality of circumferential grooves increases with each groove the wire passes through from a low tension end of each rotatable drum, where tension in the carried wire is low, towards a high tension end of each rotatable drum, where the tension in the carried wire is high, the plurality of circumferential grooves including a low tension circumferential groove located at the low tension end of the rotatable drum and a high tension circumferential groove located at the high tension end of the rotatable drum;

an actuator mechanism comprising actuators configured to move the plurality of circumferential grooves in a plane perpendicular to the rotational axis of the rotatable drum between a radially inward position and a radially outward position relative to the rotational axis of the rotatable drum without moving the plurality of circumferential grooves in a direction along the rotational axis, to adapt the circumferential length of the circumferential grooves defined by the plurality of curved segments.

2. The double drum traction winch according to claim 1, wherein each of the plurality of circumferential grooves is defined by at least four curved segments.

3. The double drum traction winch according to claim 1, wherein the plurality of curved segments are each at one end shaped for supporting an overlying end of an adjacent one of the plurality of curved segments, and at the opposite end are each shaped for engaging another adjacent one of the plurality of curved segments for support, such that the plurality of curved segments that define one circumferential groove overlap each other and are at one end supported by an adjacent one of the plurality of curved segments and at an opposite end support an adjacent one of the plurality of curved segments.

4. The double drum traction winch according to claim 1, wherein each of the plurality of circumferential grooves includes a plurality of groove sections, each of the plurality of groove sections being defined by one of the plurality of curved segment, and wherein the actuator mechanism is provided with a control system adapted to operate the actuators while the first and second rotatable drums carry the wire and are rotated, such that each of the plurality of curved segments is moved in the substantial radial direction only when the groove section defined by said curved segment only partially carries the wire or when the groove section defined by said curved segment does not carry the wire.

5. The double drum traction winch according to claim 1, wherein the plurality of curved segments are arranged parallel in rows along the longitudinal axis of the rotatable drums and wherein the actuators are common to such a row of curved segments for moving the curved segments of the row of the plurality of curved segments simultaneously.

6. The double drum traction winch according to claim 5, wherein for each of the first and second rotatable drums, the actuators of the actuator mechanism each comprise a cam shaft supported by the core body of the respective rotatable drum, the cam shaft extending in a direction parallel to the rotational axis of the respective rotatable drum, and each cam shaft interacting with a row of curved segments for simultaneous movement in the radial direction of the row of curved segments by rotating the cam shaft.

7. The double drum traction winch according to claim 1, wherein for each of the first and second rotatable drums, the actuator mechanism is adapted to move the plurality of curved segments of the respective rotatable drum relative to each other at a predetermined and fixed ratio to adjust a circumferential length of each circumferential groove in relation to a predetermined non-linear elastic behaviour of the wire.

8. The double drum traction winch according to claim 1, wherein the actuator mechanism is provided with a control system comprising one or more sensors for detecting a speed of the wire and/or tension in the wire carried by the rotatable drum, and wherein the control system is adapted to operate the actuators such that the plurality of curved segments are positioned in dependence of the actual tension and thus the stretch of the wire for forming grooves having a circumferential length such that a surface of the curved segment carrying the wire has substantially the same speed as the wire.

9. The double drum traction winch according to claim 1, wherein a diameter of the rotatable drum is at least 2 meter, and a position of each of the plurality of curved segments can be adjusted in the radial direction at least over a range of up to 10 mm.

10. The double drum traction winch according to claim 1, wherein for each of the first and second rotatable drums, the core body supports at fixed angularly spaced locations cam shafts that extend parallel to and at equal radial distance from the rotation axis of the respective rotatable drum, wherein the curved segments of a first row of curved segments each have a first end cooperating with a first cam shaft to displace said first end substantially in radial direction, the curved segments of the first row each have a second end supported by a first end of a curved segment of an adjacent second row of curved segments, and a second cam shaft cooperates with the first ends of the curved segments of the second row to displace said first ends of the curved segments of the second row in the radial direction.

11. The double drum traction winch according to claim 10, wherein for each cam shaft a cam shaft actuator is provided on the core body, and wherein said cam shaft actuators are operable independent from one another.

12. A method of using a double drum traction winch according to claim 1 in off-shore operations.

13. A vessel provided with a double drum traction winch according to claim 1.

14. A method for reducing wire slip on a double drum traction winch, the method comprising the steps of:

providing a double drum traction winch according to claim 1;

providing a storage drum with a wire to be carried by the double drum traction winch;

adjusting the radial position of the plurality of curved segments and thus adjusting the circumferential length of each of the plurality of circumferential grooves defined by the plurality of curved segments;

guiding the wire from the storage drum to the traction winch, winding the wire about the two traction drums such that the wire is carried by the plurality of circumferential grooves;

guiding the wire from the traction winch to a first load, and connecting the wire to the first load;

lifting or lowering the first load using the traction winch and the wire.

15. The method according to claim 14, comprising the step of adjusting circumferences the plurality of circumferential grooves simultaneously, by adjusting radial positions of the plurality of curved segments, while the first and second rotatable drums are carrying the wire.

16. The method according to claim 15, comprising the step of dynamically adjusting the circumferences the plurality of circumferential grooves simultaneously, by adjusting the radial positions of the plurality of curved segments while the first and second rotatable drums are rotated, wherein each of the plurality of circumferential grooves includes a plurality of groove sections, each of the plurality of groove sections being defined by one of the plurality of curved segment, and each of the plurality of curved segments is moved in the substantial radial direction only when the groove section defined by said curved segment only partially carries the wire or when the groove section defined by said curved segment does not carry the wire, and wherein positions of the plurality of curved segments defining one circumferential groove is adjusted in a consecutive fashion along the circumferential length of the one circumferential groove.

* * * * *